US008881673B2

(12) United States Patent
Griffin et al.

(10) Patent No.: US 8,881,673 B2
(45) Date of Patent: Nov. 11, 2014

(54) APPARATUS AND METHOD FOR THE APPLYING OF REFRACTORY MATERIAL

(75) Inventors: Richard Charles Griffin, Mt. Bethel, PA (US); Stephen Peter Giordanengo, Cranberry Township, PA (US)

(73) Assignee: Specialty Minerals (Michigan) Inc., Bingham Farms, MI (US)

( * ) Notice: Subject to any disclaimer, the term of this patent is extended or adjusted under 35 U.S.C. 154(b) by 776 days.

(21) Appl. No.: 12/602,739

(22) PCT Filed: Jun. 9, 2008

(86) PCT No.: PCT/US2008/007188

§ 371 (c)(1),
(2), (4) Date: Dec. 2, 2009

(87) PCT Pub. No.: WO2008/153982

PCT Pub. Date: Dec. 18, 2008

(65) Prior Publication Data

US 2010/0196598 A1 Aug. 5, 2010

Related U.S. Application Data

(60) Provisional application No. 60/933,556, filed on Jun. 7, 2007.

(51) Int. Cl.

| | |
|---|---|
| ***B05D 7/22*** | (2006.01) |
| ***B05B 13/06*** | (2006.01) |
| ***B05D 1/02*** | (2006.01) |
| ***B05B 3/10*** | (2006.01) |
| ***F27D 1/16*** | (2006.01) |

(52) U.S. Cl.

CPC ..... *B05B 3/1021* (2013.01); *F27D 1/1642* (2013.01); *B05B 13/0636* (2013.01)

USPC ..... 118/317; 427/236

(58) Field of Classification Search

USPC ..... 427/230–239; 118/317

See application file for complete search history.

(56) References Cited

U.S. PATENT DOCUMENTS

| | | | | |
|---|---|---|---|---|
| 3,237,865 | A * | 3/1966 | Bela Kovach | 239/142 |
| 3,736,094 | A * | 5/1973 | Shisler | 431/158 |

(Continued)

FOREIGN PATENT DOCUMENTS

| | | |
|---|---|---|
| JP | SHO 52-102804 A | 8/1977 |
| JP | SHO 56-15860 A | 2/1981 |
| KR | 1983-0000121 | 2/1983 |

OTHER PUBLICATIONS

International Preliminary Report on Patentability for PCT/US2008/007188, Dec. 7, 2009, 5 pages.*

(Continued)

*Primary Examiner* — William Phillip Fletcher, III

(74) *Attorney, Agent, or Firm* — Leon Nigohosian, Jr.

(57) ABSTRACT

An apparatus for the applying of refractory material in 360 degrees while the apparatus is raised or lowered vertically or inserted and retracted horizontally can apply a layer of material continuously on the interior surface of a hot vessel. Wet mixed refractory material is supplied to an applicator and pressurized air is supplied to the applicator so as to rotate a spinner head on the applicator. The apparatus includes a shroud around the housing of the applicator which conveys the pressurized air around the housing to cool the housing below the temperature of the vessel. Also described is a method of applying refractory material by a spinner head on the applicator in the form of a spray to hot metallurgical vessels such as the snorkel tubes of vacuum degassers and ladles.

24 Claims, 15 Drawing Sheets

(56) References Cited

U.S. PATENT DOCUMENTS

| | | | | | |
|---|---|---|---|---|---|
| 3,799,445 | A | * | 3/1974 | Marino | 239/242 |
| 4,033,514 | A | * | 7/1977 | Weiss et al. | 239/662 |
| 4,108,384 | A | * | 8/1978 | Egli | 239/665 |
| 4,120,260 | A | | 10/1978 | Kubo et al. | |
| 4,181,258 | A | * | 1/1980 | Ogawa | 239/752 |
| 4,199,108 | A | * | 4/1980 | Baumgartner et al. | 239/662 |
| 4,211,367 | A | * | 7/1980 | Allison | 239/226 |
| 4,272,020 | A | * | 6/1981 | Allison | 239/8 |
| 4,421,275 | A | * | 12/1983 | Gratton | 239/226 |
| 4,779,798 | A | * | 10/1988 | Natolino et al. | 239/227 |
| 6,915,966 | B2 | | 7/2005 | Gist et al. | |
| 2005/0194466 | A1 | * | 9/2005 | Gist et al. | 239/290 |

OTHER PUBLICATIONS

PCT International Search Report on Corresponding PCT International Application No. PCT/US2008/007188.

* cited by examiner

*FIG. 1*

VAC DG1
TIME TABLE

- PHASE ONE - RH MAINTENANCE USING OPTISHOT®SP AND ECOSHOT™ 30 REGULAR GROUTING OF HEARTH.
- PHASE TWO - INTRODUCTION OF OPTISHOT®SP-FG FOR UP & DOWN LEG MAINTENANCE.
- PHASE THREE - INTRODUCTION OF OPTISHOT®SP-FG MAINTENANCE USING THE SPINNER NOZZLE.
- PHASE FOUR - INTRODUCTION OF THE MIX-O-MAT HOPPER FOR AUTOMATIC FEEDING OF OPTISHOT®SP-FG USING THE SPINNER NOZZLE.

VAC DG1 PHASE ONE
OPTISHOT SP REGULAR GROUTING

END OF CAMPAIGN
(TOTAL NUMBER OF HEATS BEFORE RELINING)

VAC DG1 PHASE TWO
INTODUCTION OF SP-FG

VAC D61 PHASE THREE INTRODUCTION OF SPINNER NOZZLE

AVERAGE CAMPAIGN LENGTH
VAC DG1

APPARATUS AND METHOD FOR THE APPLYING OF REFRACTORY MATERIAL

BACKGROUND

The present invention relates to an apparatus and a method for the applying of monolithic refractory materials. Gunning devices which apply a material onto a target substrate for producing or repairing refractory linings are generally known.

SUMMARY OF THE INVENTION

According to the present invention, an apparatus and a method for the applying of refractory material is provided.

In some embodiments, an apparatus for the applying of refractory material includes an applicator for continuously applying refractory material 360 degrees in a substantially radial direction. While the applicator is raised or lowered vertically or inserted and retracted horizontally, a layer of refractory material is formed on a preselected area of a target substrate such as the interior surface of a hot vessel. Wet mixed refractory material is supplied to the applicator along with pressurized air. A means for rotating a spinner head of the applicator is provided which can be pressurized air supplied to the applicator which rotates an air rotor which in turn rotates the spinner head of the applicator such that refractory material exits the spinner head in a radial direction. The apparatus includes a means for cooling the housing of the applicator. The means for cooling the housing of the applicator can be a shroud around the housing of the applicator which permits pressurized air supplied to the housing to exit the applicator. The pressurized air passes along the housing and exits the shroud so as to cool the housing below the temperature of the vessel.

In some embodiments, a method of applying refractory material to a refractory surface or a surface of a metallurgical vessel includes positioning a housing opposite the surface, supplying a wet mixture to the housing, conveying the wet mixture through the housing to a nozzle, rotating the nozzle at a preselected speed, and applying the wet mixture to a preselected area of the target surface in the form of a spray. The wet mixture can be applied through a hoseline and pressurized air can be supplied to the applicator as described above thus permitting the applicator to be moved relative to a target surface. The wet mixture can be applied manually directly by an operator who positions the application such that the wet mixture is sprayed onto a target surface and a sufficient thickness of sprayed coating is built up. In the alternative, a mechanical means can be used to position and move the applicator into a position in which a sufficient thickness of sprayed coating is built up. A mechanical means can be provided which moves the applicator while the spinner head is spinning at a rate sufficient to provide a continuous sprayed coating on the target surface as the applicator moves in the direction of the axis of rotation of the spinning head.

Refractory material can be applied by the method of the present invention by a spinner head or nozzle of the applicator in the form of a spray to hot or cold surfaces of metallurgical vessels such as ladles, the up and down legs of the snorkel tubes of vacuum degassers as well as vacuum degas vessels.

After the refractory material has been applied, the sprayed-on lining or layer maintains the refractory lining against attack by corrosive materials such as molten slags and molten metals, especially against attack by acid and basic slags, and steel.

Application of the refractory material can be performed while the lining material is at a temperature of about 13 degrees Celsius to about 1600 degrees Celsius, in one embodiment about 1200 degrees to about 1500 degrees Celsius.

BRIEF DESCRIPTION OF THE DRAWINGS

FIG. 1 is a description of the Timetable for campaigns conducted with and without the applicator of the present invention in a vacuum degasser;

DETAILED DESCRIPTION OF THE INVENTION

The invention will now be described in detail by reference to the following specification and non-limiting examples. Unless otherwise specified, all temperatures are in degrees Celsius.

Without further elaboration, it is believed that one skilled in the art can, using the preceding description, utilize the present invention to its fullest extent. The following embodiments are, therefore, to be construed as merely illustrative, and not limitative of the remainder of the disclosure in any way whatsoever.

Figure 7:
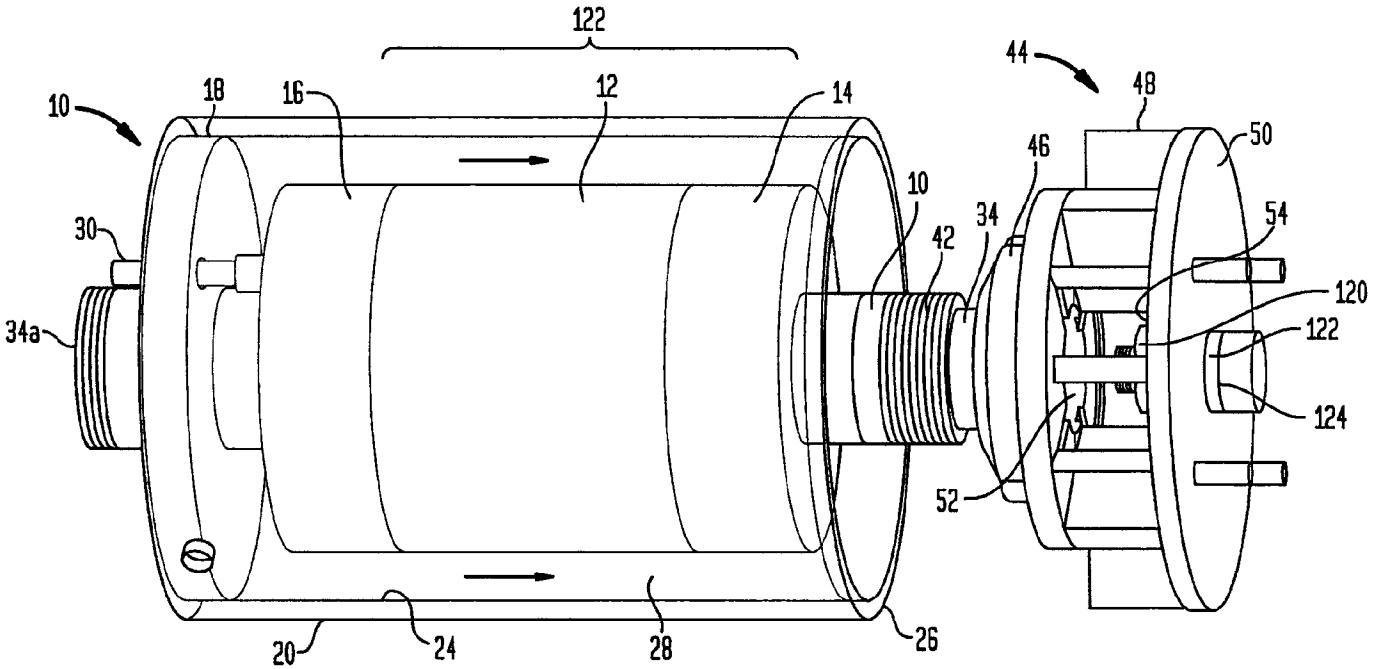
FIG. 7 is an illustration of an exemplary applicator of an embodiment of the apparatus of the present invention without an air fitting and showing the spinner head unscrewed from the refractory feed pipe.
Figure 17:
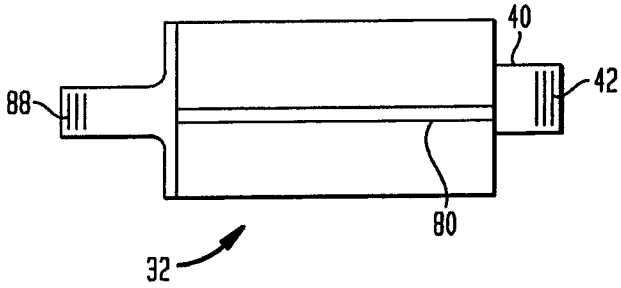
FIG. 17 is a side view of the air rotor showing the blade slot.

Referring now to the drawings in detail, wherein like reference numerals indicate like elements through the several views, there is shown in FIG. 7 an applicator 10 according to the present invention having a housing base piece 12 attached to end cap 14 and exhaust cap 16. Shroud base piece 18 supports shroud 20 which surrounds housing 22. Shroud 20 shown here substantially cylindrically can be any shape or configuration so as to provide a means for permitting the passage of gas, here air, along the housing 22 of the applicator 10 so as to cool housing 22. Inner wall 24 of shroud 20 defines the contour or the passageway 28 by which air exits the open shroud end 26 in the direction shown by the arrows in the passageway 28. Air fitting 30 which extends through shroud base piece 18 fits up to exhaust cap 16 and provides a supply of air to applicator 10 which rotates rotor 32 shown in FIG. 17 as described below.

Figure 19:
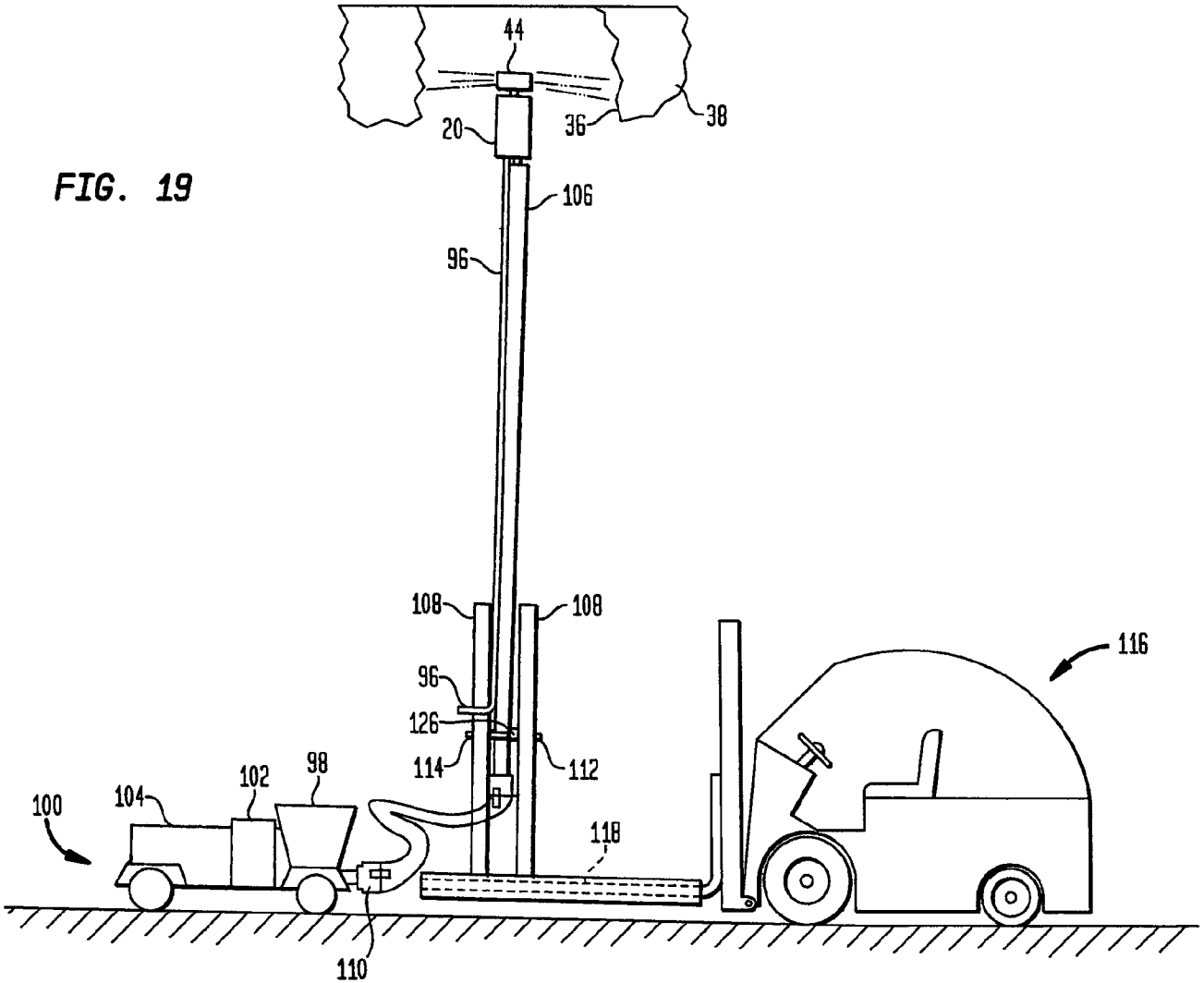
FIG. 19 is an elevation view of the apparatus for use in an exemplary process according to one embodiment of the present invention.
Figure 20:
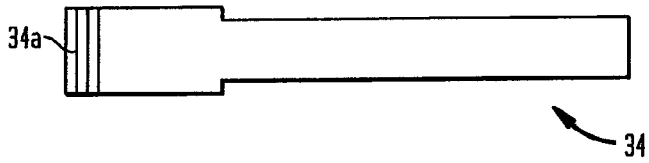
FIG. 20 is a plan view of the inner sleeve of the applicator.
Figure 21:
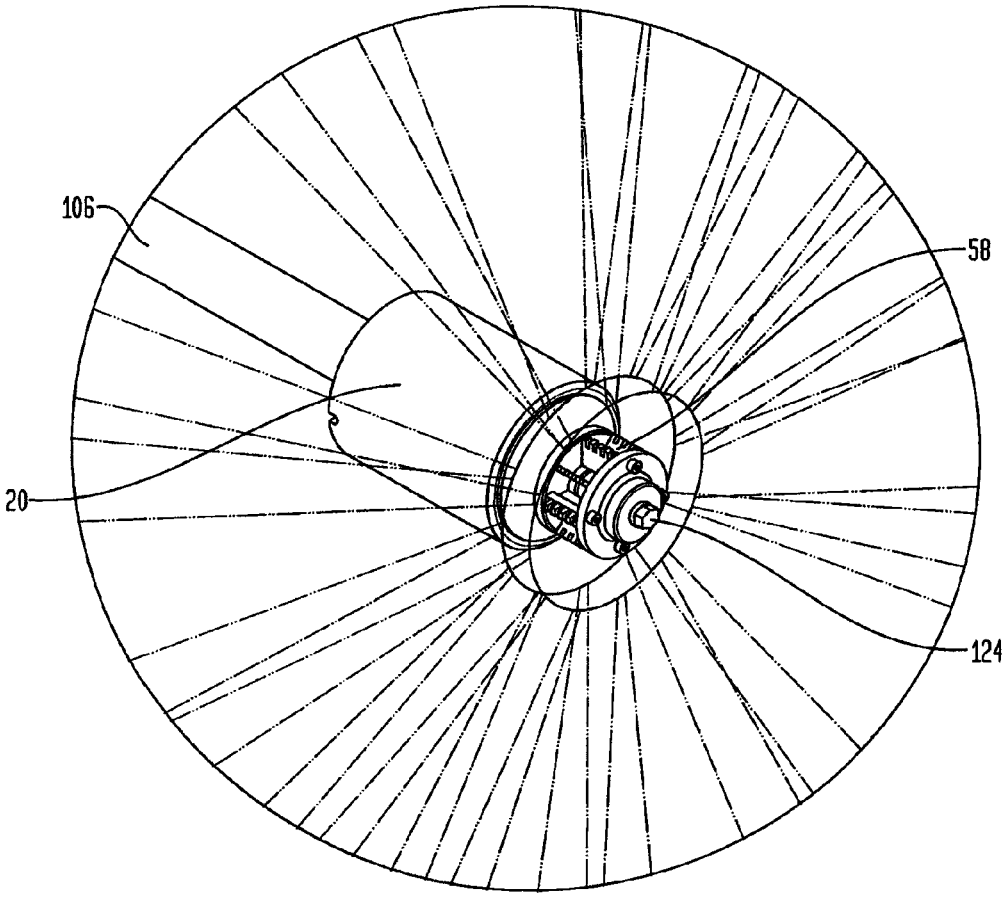
FIG. 21 is a perspective view of the applicator of the present invention showing the spraying of a wet mixture of refractory material for forming a refractory lining on a target surface.

Inner sleeve 34 which extends through the length of applicator 10 provides a means for transferring wet mix, here refractory material to be applied to a target surface, for example on interior snorkel surface 36 on Rheinstahl Heraeus degasser snorkel 38 as seen in FIG. 19.

Air rotor head pipe 40 which rotates together with air rotor 32 has rotor head pipe threaded portion 42 which provides a means for fastening to spinner head 44 at an interior threaded portion (not shown) on spinner head base piece 46. Vanes 48 which are connected to spinner head base piece 46 are in turn attached to spinner head face piece 50. Spinner head nut 120 engages spinner head bolt 124 which is adjacent to spinner head washer 122 thus permitting adjustment of the flow characteristics of the wet refractory material flowing toward spinner head interior face during operation of the applicator 10 through the use of spinner head washers 122 of different thickness or number and spinner head bolts of different sizes.

During operation of the applicator 10, wet mix which is pumped to inner sleeve 34 passes through spinner head aperture 52 where the wet mix engages interior spinner head face 54 of spinner head 44. Wet mix which exits inner sleeve 34 flows toward interior spinner head face 54 and between vanes 48 of spinner head 44 which rotates during operation. As spinner head 44 rotates the rotating action of vanes 48 spray a coating of wet mix, here refractory material in the radial direction as spinner head 44 rotates about an axis as seen in FIG. 19.

Operation of the applicator 10 and the means for rotating the spinner head 44 here, by air rotor 32 can be understood by way of an explanation of how to disassemble the housing 22. After unscrewing exhaust end cap pipe 60 from shroud base piece 18 from exhaust cap threaded portion 62, inner sleeve 34 can be removed from the inside of the exhaust end cap pipe 60, if necessary by gripping inner sleeve fitting **34*a* and twisting the inner sleeve. End cap 14 can then be removed from the remaining portion of the housing 22 by removing two allen bolts (not shown) from end cap aperture 64**.

Figure 9:
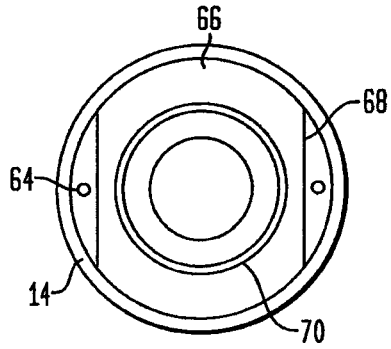
FIG. 9 is a plan view of the end cap of the housing of the applicator showing an end cap ring having two flat sides and a bearing.
Figure 10:
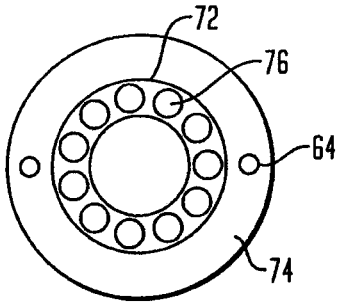
FIG. 10 is a plan view of the bearing which fits inside of the housing end cap.
Figure 11:
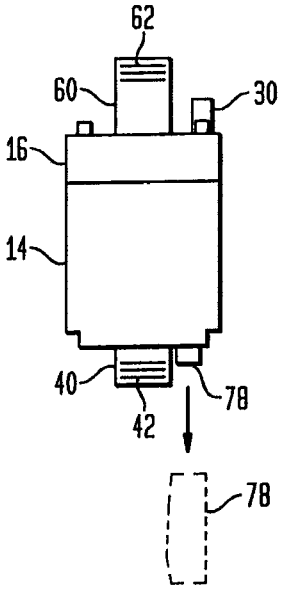
FIG. 11 is a side view of the housing of the application shown with the housing end cap removed and showing a blade on the air rotor.
Figure 12:
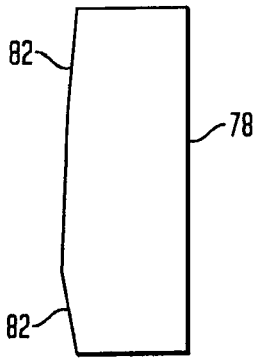
FIG. 12 is a detailed view of a blade showing a tapered angle at both ends of the blade for the air rotor shown in FIG. 11 after removal from the air rotor.
Figure 13:
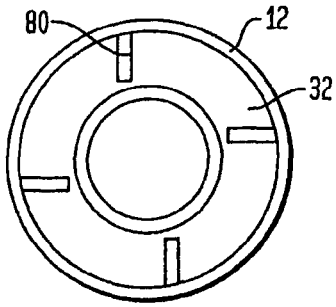
FIG. 13 is a plan view of the top face of the air rotor shown in the housing base piece showing blade slots for blades.

As seen in FIG. 9, retaining ring 66 has retaining ring flat sides 68. Retaining ring 66 has retaining ring groove 70 on each face which serves to align bearing top portion 72 of bearing 74 which has the form of a truncated cone. In one embodiment, bearing 74 has ball bearings 76 as shown in FIG. 10. Now that end cap 14 has been removed, blades 78 can be removed from a friction fit as shown in FIG. 11 from blade slots 80 as seen in FIG. 13. The blades 78 have tapered portion 82.

Figure 14:
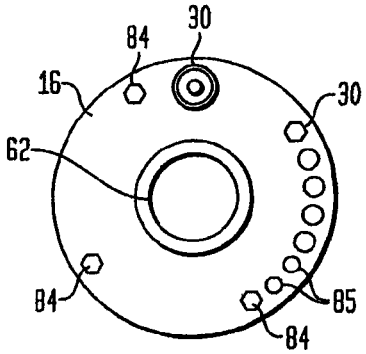
FIG. 14 is a plan view of the exhaust end cap showing the four bolts for joining the exhaust end cap to the housing base piece.
Figure 15:
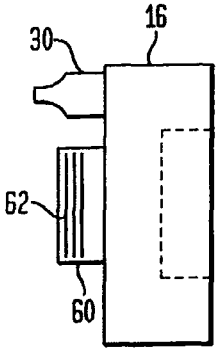
FIG. 15 is a side view of the exhaust end cap with the bolts removed and showing the inner face and sidewalls which define a cavity in the exhaust end cap for the air rotor.

At an opposite end of the housing from the blades 78 is exhaust cap 16. As seen in FIG. 14, four hexagonal bolts 84 are removed to separate housing base piece 12 from exhaust cap 16. Six exhaust cap apertures 85 are located together along the perimeter of exhaust cap 16 so as to provide a passageway for the pressurized air to exhaust after traveling over blades 78 resulting in the rotation of air rotor 32. Also aiding in the rotation of the air rotor 32 is the offset configuration of blades slots 80 in air rotor 32 which hold blades 78.

Figure 16:
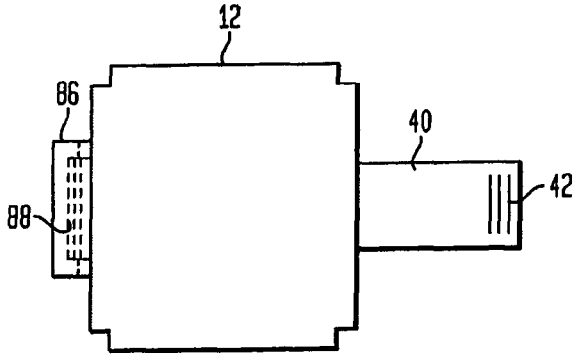
FIG. 16 is a side view of the housing base piece shown with the air rotor inside and a retaining ring on a threaded portion of the air rotor end shaft.
Figure 18:
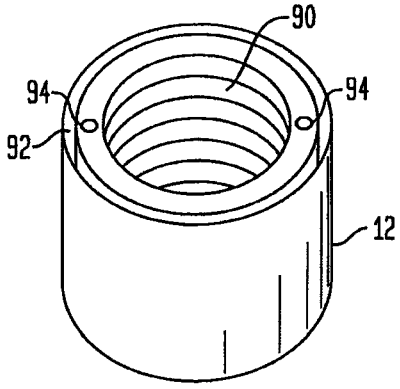
FIG. 18 is a perspective view of the housing base piece showing a step-shaped structure on the interior of the housing base piece side wall.

As shown in FIG. 16, rotation of air rotor 32 independent of the housing 22 is achieved by the engagement of retainer nut 86 on a threaded portion of air rotor exhaust end pipe 88 such that retainer nut 86 does not rotate relative to air rotor 32 but does indeed rotate relative to housing base piece 12. FIG. 18 depicts housing base piece 12 having internal ridges 90 and setback edge 92 which permits fitup of end cap 14. Housing base piece 12 is provided with apertures 94 to accommodate allen bolts to connect with end cap 14.

Figure 8:
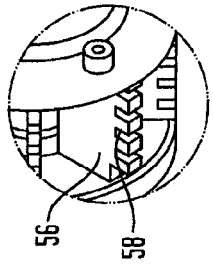
FIG. 8 is a detailed view of vanes of the spinner head showing a plurality of teeth on the vanes.

In another embodiment of the apparatus of the present invention, the vanes 56 of spinner head 44 have teeth 58 as seen in FIG. 8 rather than extending continuously from spinner head base piece 46 to spinner head face piece 50.

In yet another embodiment of the present invention, the spinner head 44 can be driven by a motor such as an electric motor or a hydraulic motor.

As seen in FIG. 19, in operation, pressurized air is provided at air fitting 30 through air line 96. Dry refractory material is placed in the hopper 98 of mixer unit 100 which has control panel 102 and mixer 104 for mixing a wetting agent such as water and dry refractory material. During operation of the mixer, wetted refractory material is pumped at mixer fitting 110 through hoseline 106 which is supported by supporting means 108. The supporting means can be any means for supporting the hoseline 106 or conveying means for the wetted refractory material which permits movement of the applicator for operation of the application at a preselected location. Here the supporting means includes vertical member 108 and a clamping means for engaging hoseline 106. The clamping means is a horizontal member 126 having a semicircular shaped cutout portion for accommodating a portion of the circular cross-sectional profile of the hoseline 106. The clamping means includes bolt clamping means 112 and clamping means nut 114.

In FIG. 19 the means for moving the applicator to a preselected operating position to apply refractory material to a preselected target surface is a forklift 116 which has forks 118 which can be raised and lowered by a forklift operator. In another embodiment, the applicator can be held at the same location while the target surface is raised, lowered or moved in any direction having vertical and/or horizontal components while the target surface is coated by the applicator.

In another embodiment, both the applicator and the target surface can each be moved in a direction having a vertical and/or horizontal component during coating of the target surface by the applicator.

In yet another embodiment, the applicator can be moved in a direction having a vertical and/or horizontal component while the target surface is coated by the applicator.

In another embodiment, mechanical means other than a forklift can be used to raise and lower the applicator.

EXAMPLE 1

Figure 2:
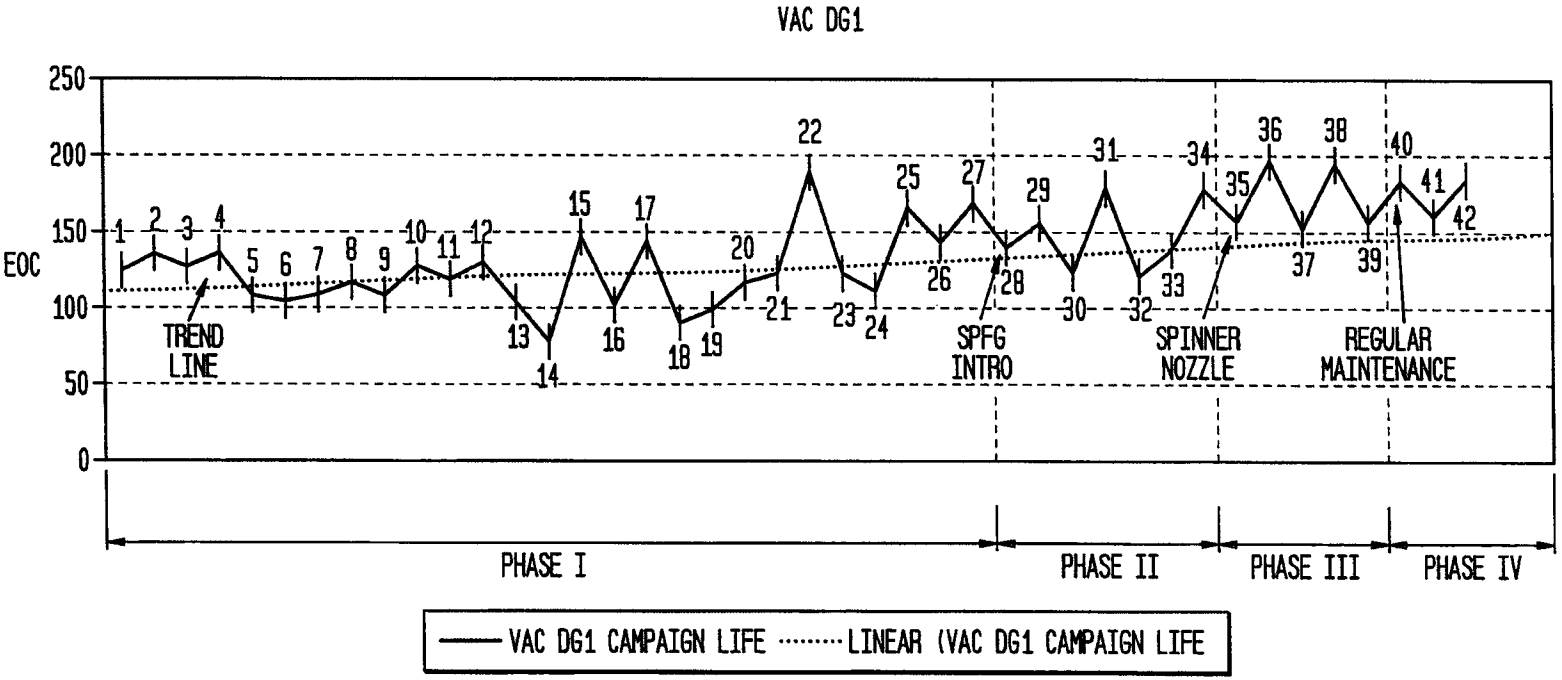
FIG. 2 is an illustration of the length of the campaigns or total number of heats prior to relining the vacuum degasser for each of the four phases of FIG. 1.
Figure 3:
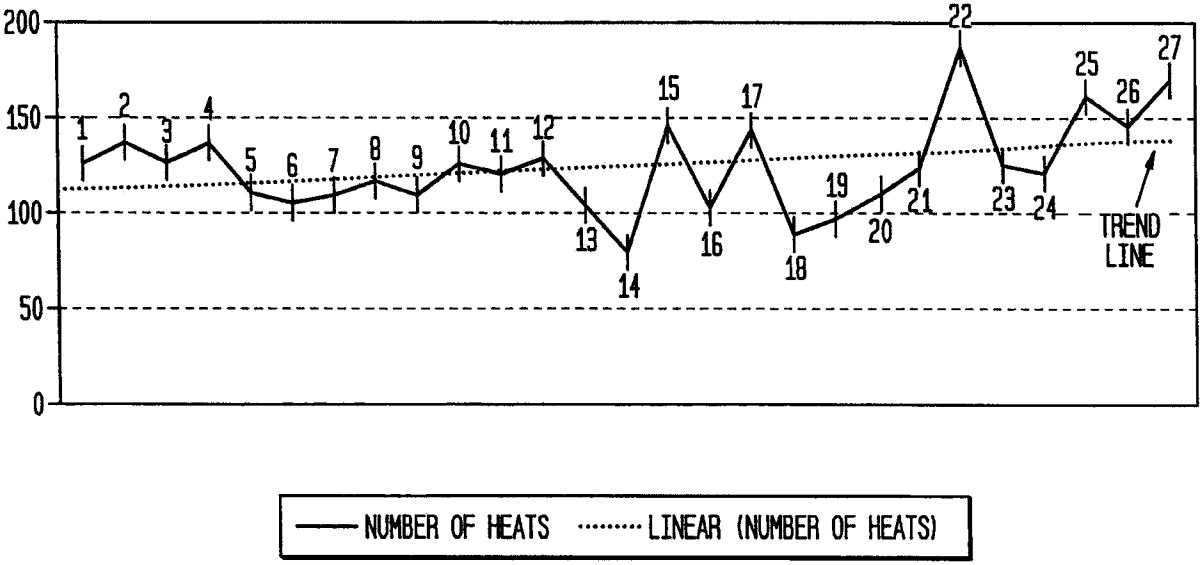
FIG. 3 is an illustration of the length of the campaigns or total number of heats prior to relining the vacuum degasser for phase one.
Figure 6:
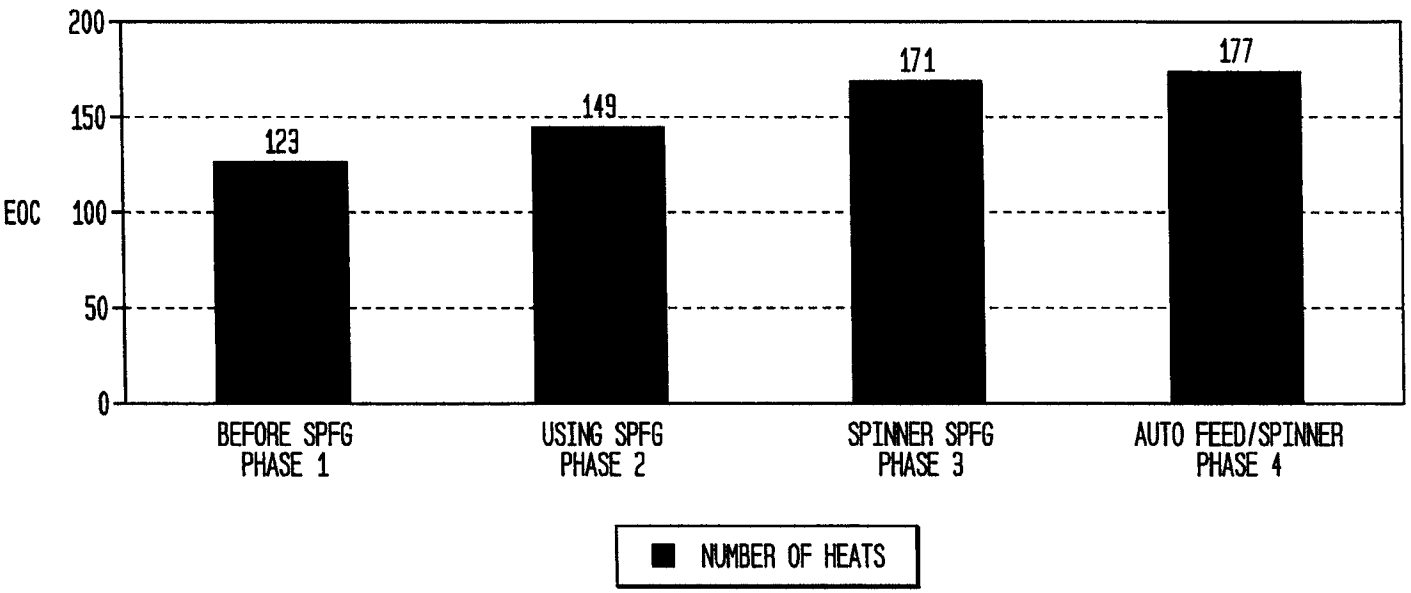
FIG. 6 is an illustration of the average length of the campaigns or total number of heats prior to relining the vacuum degasser for each of the four phases.

As stated in FIG. 1, in Phase 1, an RH vacuum degasser was maintained using OPTISHOT® SP and ECOSHOT™ 30 refractory materials of Minteq International Inc. of New York, N.Y. using grouting techniques. As can be seen in FIGS. 2, 3 and 6, the average length of a campaign of heats of the RH vacuum degasser until the end of the campaign (EOC) was 123.

EXAMPLE 2

Figure 4:
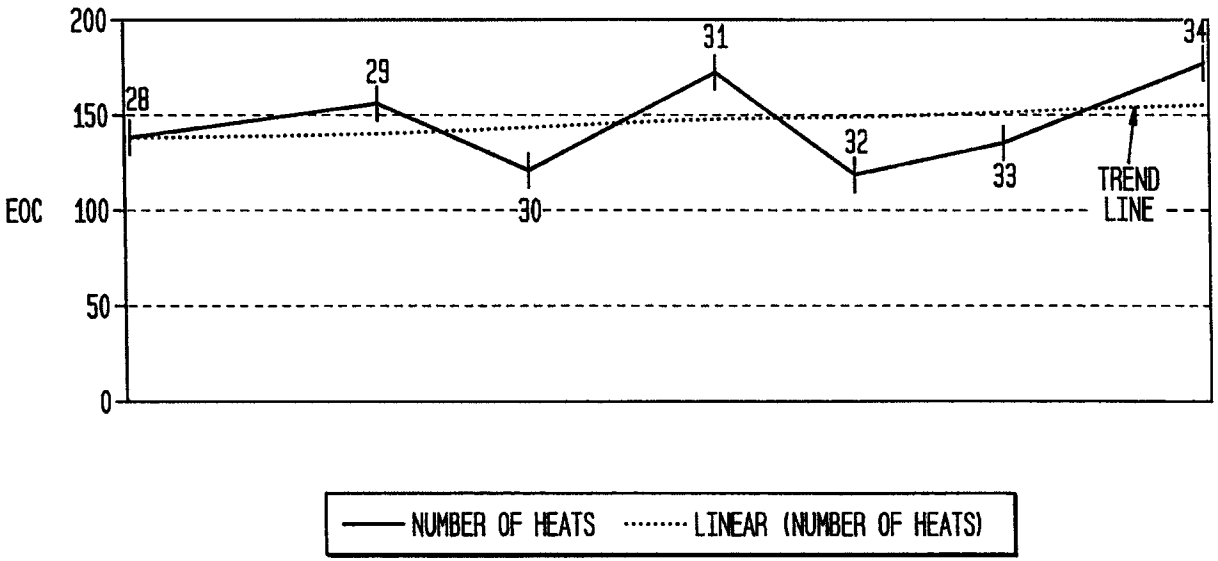
FIG. 4 is an illustration of the length of the campaigns or total number of heats prior to relining the vacuum degasser for phase two.

As stated in FIG. 1, in Phase 2, the up and down snorkel legs of an RH vacuum degasser were maintained using OPTISHOT® SP-FG refractory material and grouting techniques. As can be seen in FIGS. 2, 4 and 6, the average length of a campaign of heats of the RH vacuum degasser until the end of the campaign (EOC) was 149.

EXAMPLE 3

Figure 5:
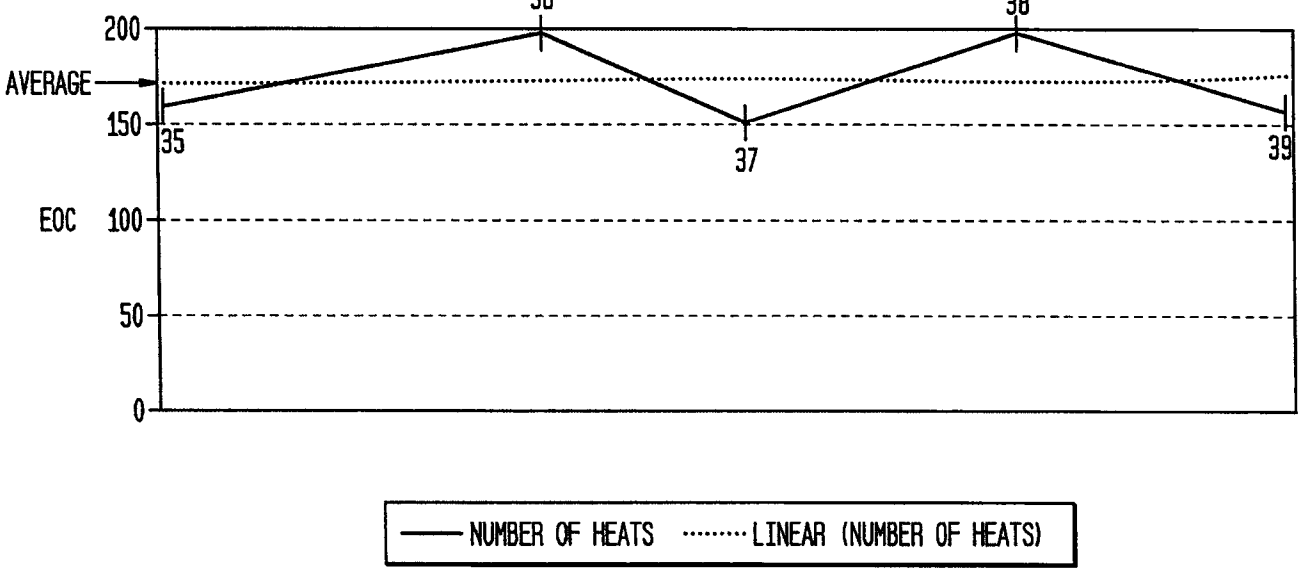
FIG. 5 is an illustration of the length of the campaigns or total number of heats prior to relining the vacuum degasser for phase three.

As stated in FIG. 1, in Phase 3, the up and down snorkel legs of an RH vacuum degasser were maintained using OPTISHOT® SP-FG refractory material using an applicator of the present invention having a spinner head. The applicator used an Airline AL-20 spinning nozzle on a two and one-half meter long shaft which is available from Blastcrete of Anniston, Ala. The applicator was mounted vertically on a two and one-half meter long shaft and a one-inch pipe fed wet mixed refractory material to the applicator and a one-half inch air line was supplied to the applicator to power the air rotor. As can be seen in FIGS. 2, 5 and 6, the average length of a campaign of heats of the RH vacuum degasser until the end of the campaign (EOC) was 171.

EXAMPLE 4

As stated in FIG. 1, in Phase 4, the up and down snorkel legs of an RH vacuum degasser were maintained using OPTISHOT® SP-FG refractory material using an applicator of the present invention having a spinner head. The applicator used an Airline AL-20 spinning nozzle which is available from Blastcrete of Anniston, Alabama and a Duo Mix 2000 mixerunit from M-Tec Mathis Technik GmbH of Neuenberg, Germany. As can be seen in FIGS. 2 and 6, the average length of a campaign of heats of the RH vacuum degasser until the end of the campaign (EOC) was 177. In the alternative, other mixer units such as a Mix-O-Mat mixer unit from Minteq International Inc. can be used.

The above testing coatings were applied as a refractory lining. The linings met or exceeded the performance requirements in the areas of density, strength, drying, resistance to cracking, preheating, molten metal and resistance, durability and sequencing requirements.

In an embodiment of the invention, the applicator can coat monolithic refractory material on an interior surface of a metallurgical vessel or body while the body is still heated. The temperature of the target surface to be fabricated or repaired by the method of the present invention or by the apparatus of the invention to coat or line the surface can be any surface from a cold surface to a hot surface. In one embodiment, the target surface can be at from about 1200 to about 1500 degrees Celsius.

In the method of the invention, application of the coating can be applied to provide a layer of refractory lining of a thickness from about one to three centimeters to about three to eight centimeters both prior to exposing as well as after exposing the lining to corrosive materials. The providing of thicker refractory linings permits a reduction in the frequency of applications required to maintain the metallurgical vessel or structure. The applicator can be raised and lowered relative to the target surface repeatedly until the desired thickness of the coating is provided.

The structure to be coated or lined can be a cylindrical body such as a ladle, a vacuum degasser snorkel or a vacuum degasser vessel.

In one embodiment, material was applied by the applicator at a rate of from about 55 to about 75 kilograms per minute.

In another embodiment, the interior surface of a ladle or CAS-OB bells used in metallurgical operations can be lined with refractory material using the method and apparatus of the present invention by providing a means for supporting the applicator and a means for providing relative movement of the ladle with respect to the applicator.

Figure 22:
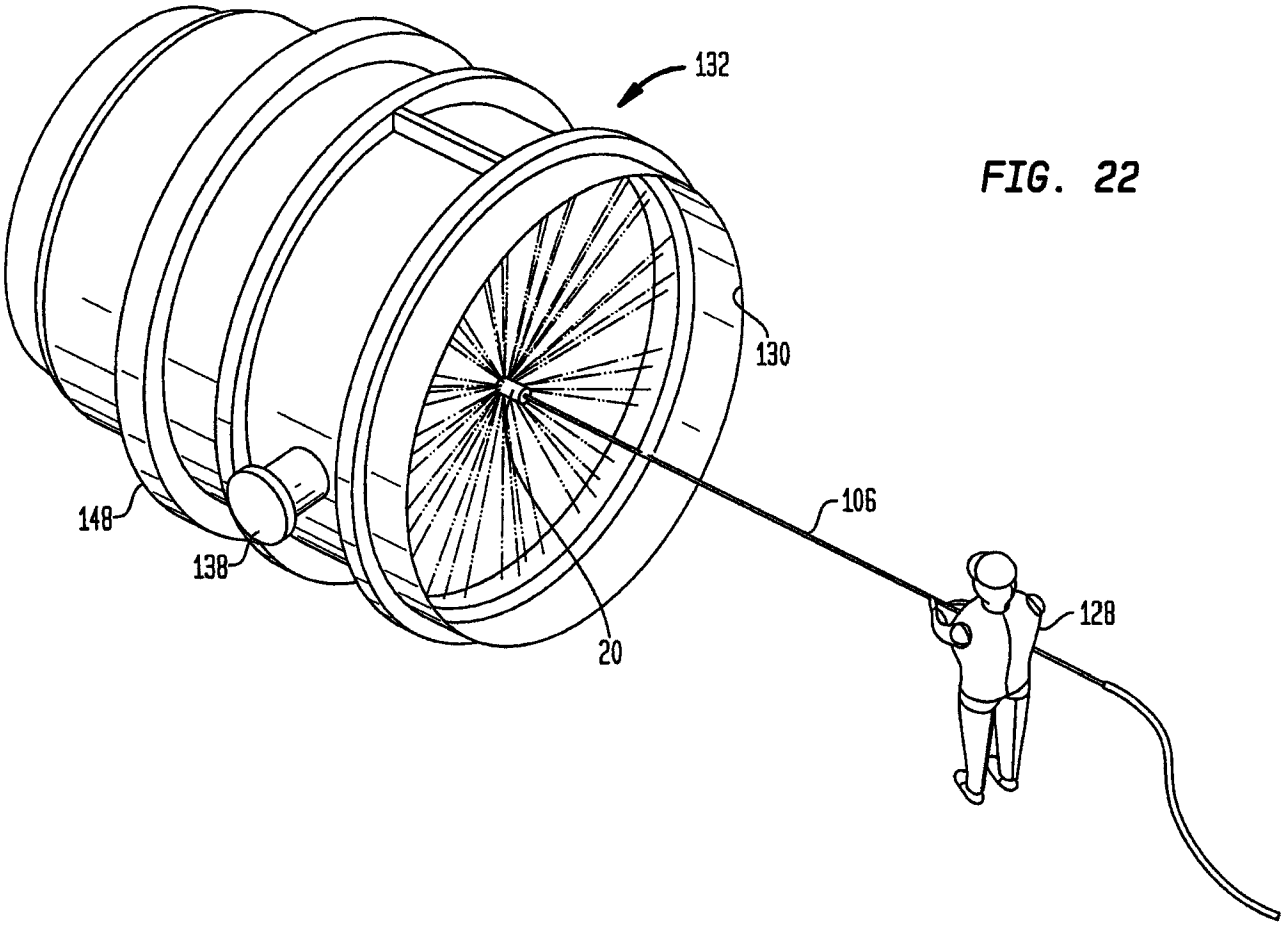
FIG. 22 is a perspective view of an operator spraying refractory material using the applicator of the present invention.

As seen in FIG. 22, an operator 128 is shown supporting the hoseline 106 which provides a wet mixture of refractory material to the applicator 10 in such a manner so as to spray a coating of refractory material to the interior surface 130 of ladle 132 which is in the horizontal position. The system shown in FIG. 22 can be used to provide a refractory lining to the interior surfaces of a ladle which is at room temperature or at temperatures at which an operator can safely carry out the method shown in FIG. 22.

Figure 23:
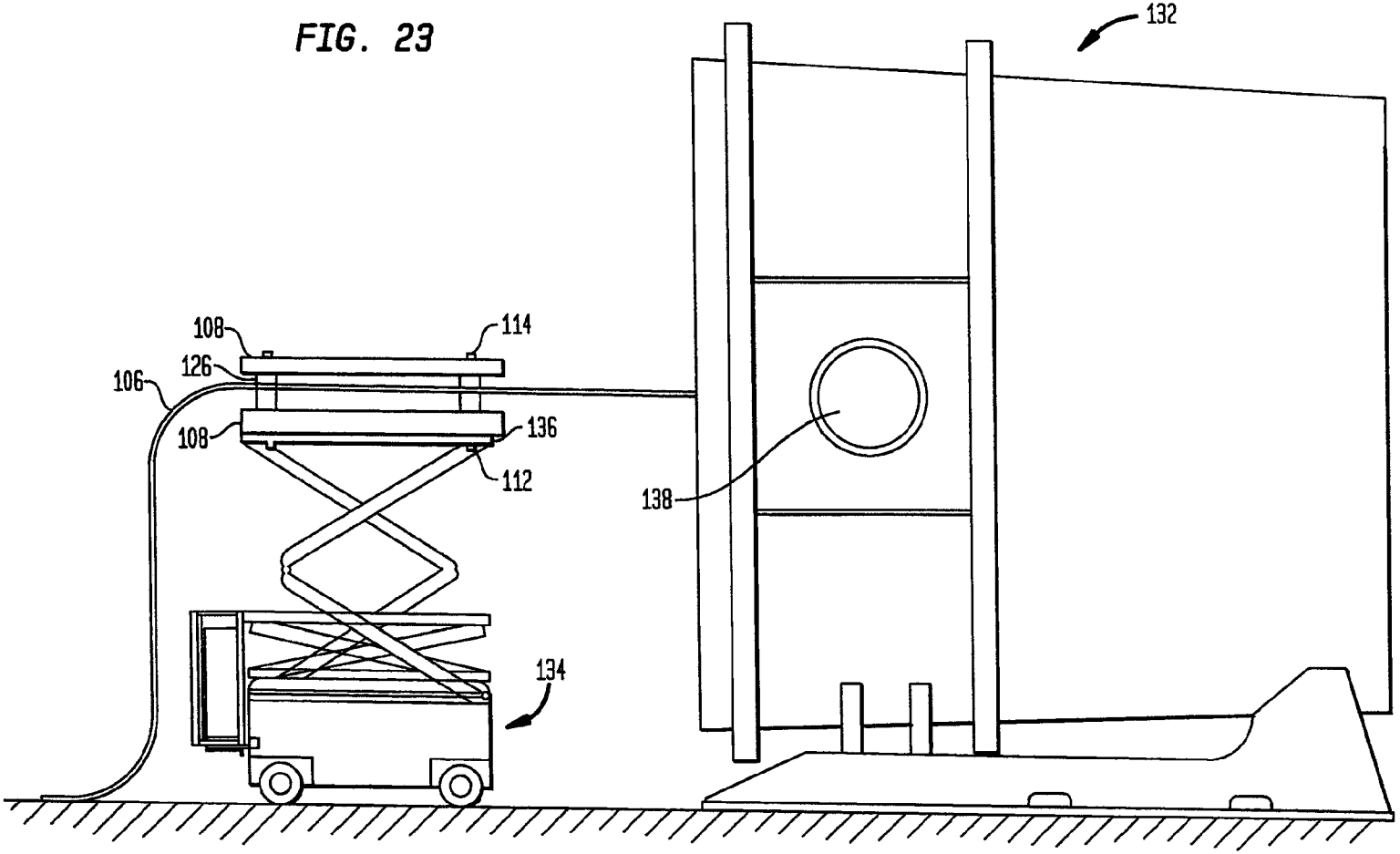
FIG. 23 is a side elevational view showing a system for providing a coating of refractory material to a horizontal ladle.

In FIG. 23 a means for supporting the applicator of the present invention is shown such that the interior surfaces of the walls of a metallurgical vessel, here a ladle 132 in the horizontal position having trunions 138, can be sprayed with refractory material. A scissors lift truck 134 having lift platform 136 supports members 108 and a clamping means for engaging hoseline 106. The clamping means is a horizontal member 126 having a semicircular shaped cutout portion for accommodating a portion of the circular cross-sectional profile of the hoseline 106. The clamping means includes bolt clamping means 112 and clamping means nut 114.

Figure 24:
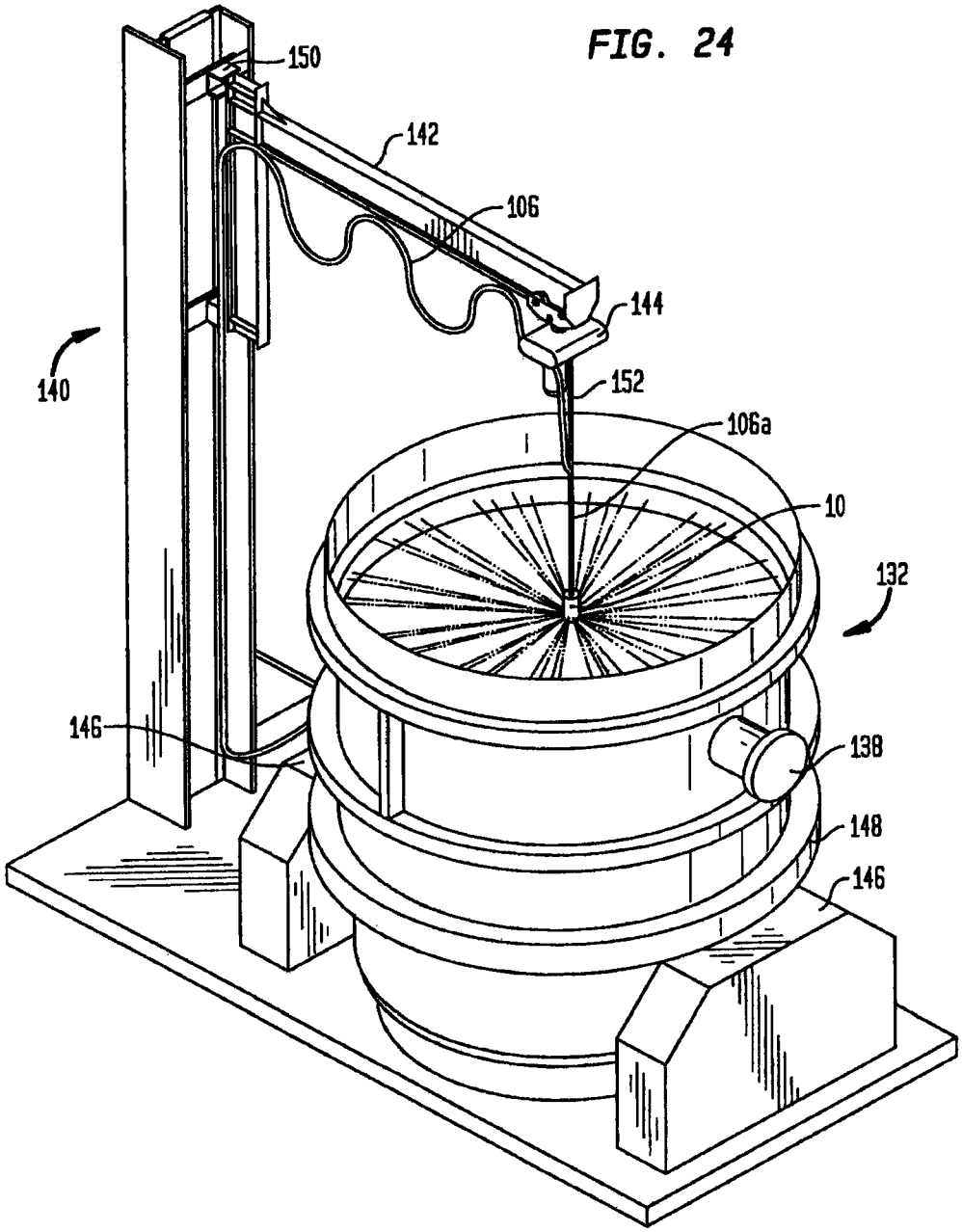
FIG. 24 is a parallel perspective view of a system for providing a coating of refractory material to a ladle in the vertical position.

In yet another embodiment as seen in FIG. 24 a means for supporting the applicator of the present invention is shown such that the interior surfaces of the walls of a metallurgical vessel, here a ladle 132 in the vertical position having trunions 138, can be sprayed with refractory material. A jib crane 140 having support member 142 supports electric motor 144 which has a means for raising and lowering rigid hoseline **106*a*. The rigid hoseline 106*a* can be substantially rigid. The means for raising and lowering the rigid hoseline 106*a* can be motor chain 152** which is pulled and released by an electromechanical drive motor (not shown) which is operated by an operator.

The electric motor 144 also has a means for moving the electric motor 144 along support member 142 in order to position the rigid hoseline **106*a* at the center of the ladle 132 at a vertical axis of the ladle 132. The means for moving the electric motor 144 along the support member 142 can be a chain (not shown) which permits an operator to pull electric motor 144 along support member 142**.

The jib crane 140 can have a means for pivoting support member 142 into a predetermined position such that electric motor 144 supports hoseline 106*a* and applicator 10. The means for pivoting support member 142 is hinge pin 150.

Ladle 132 can have a means for supporting ladle 132, here ladle support 146 which engages ladle ring 148 which provides a means for maintaining ladle 132 into a position.

Application of the refractory material can be performed prior to initial exposure of the refractory lining to the corrosive materials. Depending on the degree of erosion and/or corrosion of the lining formed on the refractory material, the refractory material of the present invention need not necessarily be reapplied to the refractory material after each run of corrosive materials over the refractory lining.

Accordingly, it is understood that the above description of the present invention is susceptible to considerable modifications, changes and adaptations by those skilled in the art, and that such modifications, changes and adaptations are intended to be considered within the scope of the present invention, which is set forth by the appended claims.

This apparatus can be used in applications outside of those for fabricating or repairing refractory linings.

We claim:

1. A method for spraying a refractory product upon an interior surface of a vessel comprising:

positioning an applicator having a nozzle at a preselected location opposite the interior surface of the vessel, rotatably supporting the nozzle on the applicator, conveying a combination of refractory material and liquid wetting agent through the applicator to the nozzle, providing a supply of air to the applicator, rotating the nozzle in a preselected rotary direction, applying the combination in a spray from the nozzle onto a preselected area of the interior surface of the vessel, wherein rotating the nozzle is performed by an air rotor using the air provided to the applicator, and the combination of refractory material and liquid wetting agent is conveyed through a sleeve disposed within the air rotor.

2. The method of claim 1 wherein the combination is applied while the preselected area of the interior surface is at an elevated temperature.

3. The method of claim 1 wherein the combination is applied while the preselected area of the interior surface is at from about 1200 degrees to about 1500 degrees Celsius.

4. The method of claim 1 wherein the combination is applied while the preselected area of the interior surface is at from about 13 degrees to about 1600 degrees Celsius.

5. The method of claim 1 further comprising the step of cooling the applicator below the temperature of the vessel with a supply of air to the applicator.

6. The method of claim 1 wherein the preselected area of the interior surface of the vessel is on a ladle, a vacuum degasser, a vacuum degasser snorkel or a CAS-OB bell.

7. The method of claim 1 wherein the combination is applied at a rate of from about 55 to about 75 kilograms per minute.

8. The method of claim 1 wherein the combination is applied substantially radially with respect to axis of the preselected rotary direction.

9. The method of claim 1 further comprising the step of forming a continuous coating of refractory material on the preselected area of the interior surface of the vessel.

10. The method of claim 1 wherein the coating on the preselected area of the interior surface of the vessel is from about one centimeter to about eight centimeters thick.

11. The method of claim 1 wherein the coating on the preselected area of the interior surface of the vessel is from about three centimeters to about eight centimeters thick.

12. The method of claim 1 further comprising the step of moving the applicator along the direction of the axis of rotation of the nozzle.

13. The method of claim 1 further comprising the step of moving the vessel relative to the applicator during applying of the combination.

14. The method according to claim 1 wherein the combination of refractory material and liquid wetting agent is conveyed between a plurality of vanes in the nozzle.

15. The method according to claim 1 wherein the sleeve is disposed between blades of the air rotor.

16. A system for spraying a refractory, product upon an interior surface of a vessel comprising:

a means for positioning an applicator having a nozzle at a preselected location opposite the interior surface of the vessel, a means for rotatably supporting the nozzle on the applicator, a means for conveying a combination of refractory material and liquid wetting agent through the applicator to the nozzle, a means for supplying air to the applicator, a means for rotating the nozzle in a preselected rotary direction, a means for applying the combination in a spray from the nozzle onto a preselected area of the interior surface of the vessel, wherein the means for rotating the nozzle is an air rotor powered by air supplied to the applicator, and the means for conveying carries the combination of refractory material and liquid wetting agent through a sleeve disposed within the air rotor.

17. The system according to claim 16 wherein the means for conveying the combination is a mixer unit and pump.

18. The system according to claim 16 wherein the means for positioning the applicator is a forklift.

19. The system according to claim 16 wherein the means for positioning the applicator is a jib crane.

20. The system according to claim 16 wherein the means for rotating the nozzle is an electric motor.

21. The system according to claim 16 further comprising a means for cooling the applicator below the temperature of the preselected area of the vessel.

22. The system according to claim 21 further comprising a shroud positioned around the applicator and the means for cooling the applicator is a channel between the shroud and the applicator having a flow of air through the channel which cools the applicator.

23. The system according to claim 16 wherein the nozzle includes a plurality of vanes.

24. The system according to claim 16 wherein the sleeve is disposed between blades of the air rotor.

* * * * *